US007299921B2

(12) United States Patent
Yoshie

(10) Patent No.: US 7,299,921 B2
(45) Date of Patent: Nov. 27, 2007

(54) STAPLE PACK

(75) Inventor: Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 375 days.

(21) Appl. No.: 10/495,463

(22) PCT Filed: Nov. 15, 2002

(86) PCT No.: PCT/JP02/11958

§ 371 (c)(1),
(2), (4) Date: May 13, 2004

(87) PCT Pub. No.: WO03/041923

PCT Pub. Date: May 22, 2003

(65) Prior Publication Data

US 2005/0011787 A1 Jan. 20, 2005

(30) Foreign Application Priority Data

Nov. 15, 2001 (JP) ..... 2001-350670

(51) Int. Cl.
*B65D 85/24* (2006.01)

(52) U.S. Cl. ..... 206/340; 227/120

(58) Field of Classification Search ..... 206/340, 206/338; 227/120, 131, 136
See application file for complete search history.

(56) References Cited

U.S. PATENT DOCUMENTS 5,269,451 A * 12/1993 Udagawa et al. ..... 227/120
5,454,503 A * 10/1995 Udagawa et al. ..... 227/82
5,501,387 A 3/1996 Yoshie
5,560,529 A * 10/1996 Udagawa et al. ..... 227/136
5,676,299 A * 10/1997 Yoshie et al. ..... 227/120
6,216,936 B1 * 4/2001 Abe ..... 227/131
D480,614 S * 10/2003 Haramiishi ..... D8/49
6,899,258 B2 * 5/2005 Haramiishi ..... 227/2

FOREIGN PATENT DOCUMENTS

| | | |
|---|---|---|
| EP | 0 704 282 | 4/1996 |
| JP | 4-304977 | 10/1992 |
| JP | 8-118257 | 5/1996 |

* cited by examiner

*Primary Examiner*—Mickey Yu
*Assistant Examiner*—Steven A. Reynolds
(74) *Attorney, Agent, or Firm*—Morgan, Lewis & Bockius LLP

(57) ABSTRACT

A box-type staple pack (1) formed in accordance with planer dimensions of a staple sheet is provided with an upper face window (3), a bottom face window (4), and a rear face window (5) and is provided with a staple outlet (6) in a slit-like shape at a front face thereof. When the staple pack is charged to a staple cartridge, a pressing plate in the staple cartridge is brought into elastic contact with a lower face of the staple sheet via the bottom face window (4) and a whole staple pack (1) is pressed to a ceiling face at inside of the staple cartridge. A feed claw disposed at an upper portion at inside of the staple cartridge is brought into contact with an upper face of a topmost staple sheet exposed to the upper face window (3) and feeds the staple sheet to a front side via the staple outlet (6). Charging is facilitated by dispensing with time and labor of unpacking a package or removing a bundling strap.

7 Claims, 5 Drawing Sheets

STAPLE PACK

TECHNICAL FIELD

The present invention relates to a staple for refilling used for an electric stapler, particularly relates to a staple pack facilitated to handle by being made to be chargeable in the form of a package.

BACKGROUND ART

In a conventional electric stapler, it is general to use a throwaway type staple cartridge in which a whole staple cartridge is replaced when staples inside are used up. However, a staple cartridge of a refilling type refillable staple sheets has been spread, in order to achieve saving of resources and a reduction in wastes. A staple for refilling is distributed in a condition that staple sheets adhered with linear staples in parallel with each other are stacked and bound by a bundling strap of paper or a resin sheet, and accommodated in a paper box. A bundle of the staple sheets are taken out from the paper box and charged into a staple cartridge. The strap is removed and a cover of the staple cartridge is closed. Thereby, a mounting of the staple cartridge the electric stapler is completed.

DISCLOSURE OF THE INVENTION

According to the refilling staple sheets of the background art, the bundling strap for bundling the staple sheets must be removed after the mounting. However, when the strap is erroneously removed before the mounting, the bundle of the staple sheets is disassembled and the staple sheets cannot be charged in one motion, or the staple sheets may be broken by being dropped. Hence, there poses a technical problem to be resolved in order to facilitate to handle the replenishing staple sheet and it is an object of the invention to resolve the above-described problem.

The invention has been proposed to achieve the above-described object and provides a staple pack used by being charged to a staple cartridge of a staple refilling type for stacking staple sheets comprising linear staples adhered in parallel with each other to contain in a box-type pack, the staple pack comprising: an upper face window reaching a front end of an upper face of the box type pack from a middle portion of an upper face thereof in a front and rear direction and continuous to a staple outlet formed at an upper edge portion of a front face thereof, a rear face window provided at a center of a rear face thereof in a left and right direction to extend to two ends thereof in an up and down direction, a bottom face window continuous to a lower end of the rear face window, wherein when the staple pack is charged to the staple cartridge, a staple feed claw is brought into contact with the staple sheet via the upper face window, a pressing plate at inside of the staple cartridge is brought into contact with the staple sheet via the bottom face window.

BRIEF DESCRIPTION OF THE DRAWINGS

FIG. 1(A) is a perspective view of a staple pack containing a staple sheet, and FIG. 1(B) is a perspective view of the staple pack.

Figure 1:
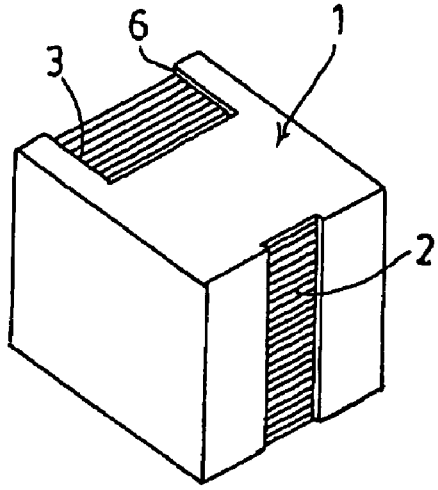
FIG. 1(A) and FIG. 1(B) show an embodiment of the invention.
Figure 1:
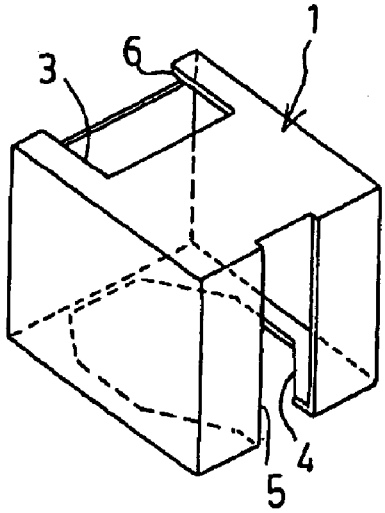

Further, in notations in the drawings, numeral 1 designates a staple pack, numeral 2 designates a staple sheet, numeral 3 designates an upper face window, numeral 4 designates a bottom face window, numeral 5 designates a rear face window, numeral 6 designates a staple outlet, numeral 13 designates a staple cartridge, numeral 14 designates an opening portion, numeral 15 designates a guide rail portion, numeral 16 designates a slide door, numeral 17 designates a tension coil spring, numeral 18 designates a compression coil spring, and numeral 19 designates a pressing plate.

DESCRIPTION OF THE PREFERRED EMBODIMENTS

A detail description will be given of an embodiment of the invention in reference to the drawings as follows. FIGS. 1(A) and 1(B) show the staple pack 1, FIG. 1(A) shows a state in delivery containing the staple sheet 2, and FIG. 1(B) shows an empty state using up the staple sheet 2. The staple pack 1 is a box made of paper formed in accordance with planar dimensions of the staple sheet 2 and is formed with the upper face window, the bottom face window 4 and the rear face window 5. The rear face window 4 is constituted by an octagonal shape in accordance with a shape of the pressing plate of the staple cartridge, mentioned later, and continuous to the rear face window 5 having a long vertical length extended to two upper and lower ends of a center of a rear face in a left and right direction. The upper face window 3 reaches a front end from a middle portion in a front and rear direction to cover an operational range of a staple feed claw at inside of the staple cartridge. An upper end portion of a front face (depth side of paper face in the drawing) is formed with the outlet 6 in a slit-like shape extended to a total width thereof and in FIG. 1(A), a topmost staple sheet is fed to a front side through the outlet 6.

Figure 2:
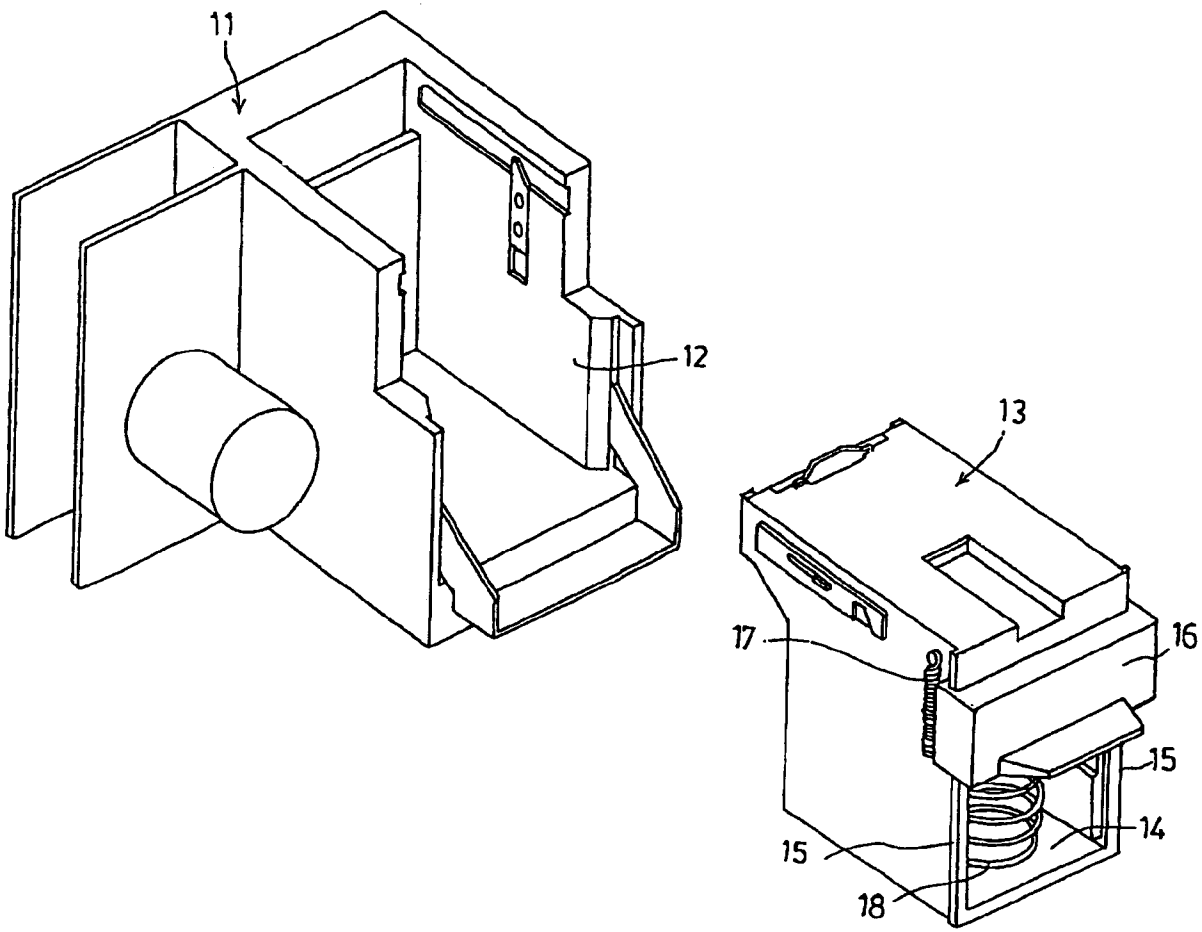
FIG. 2 is a perspective view of a staple cartridge and an electric stapler.
Figure 3:
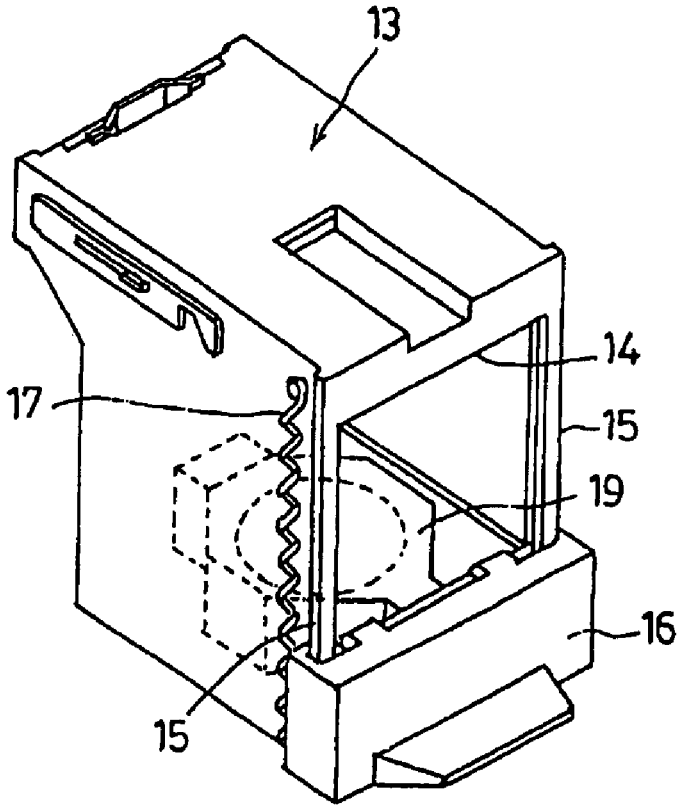
FIG. 3 is a perspective view showing the staple cartridge in a state of opening a slide door.

Next, an explanation will be given of the staple cartridge using the staple pack 1. In FIG. 2, numeral 11 designates a driver unit of an electric stapler which is arranged at inside of a copier (not illustrated) in an attitude reversing a normal attitude in an up and down direction in view of a relationship with a print face of the copier for injecting staples from the driver unit 11 to an upper clincher unit (not illustrated). The staple cartridge 13 attachable and detachable to and from a cartridge containing portion 12 of the driver unit 11 is formed with the opening portion 14 at a rear face thereof, and the slide door 16 is engaged with the guide rail portions 15 in a vertical direction formed at rear ends of two left and right side faces. The slide door 16 is pulled up to an upper side by the tension coil springs 17 made to span upper portions of the two left and right side faces of the staple cartridge 13 and the slide door 16. Further, the pressing plate, mentioned later, is included at inside of the staple cartridge 13 and the pressing plate is pushed up to the upper side by the compression coil spring 18 installed at an inner bottom face thereof. A groove (not illustrated) is formed at a lower end portion of a center of a front face (face on a side of inside of the cartridge) of the slide door 16, a rear end portion of the pressing plate is projected to a position of the groove and when the slide door 16 is pushed down to the lower side as shown by FIG. 3, the rear end portion of the pressing plate 19 is engaged with the groove and also the pressing plate 19 is moved down simultaneously as shown by the drawing.

Figure 4:
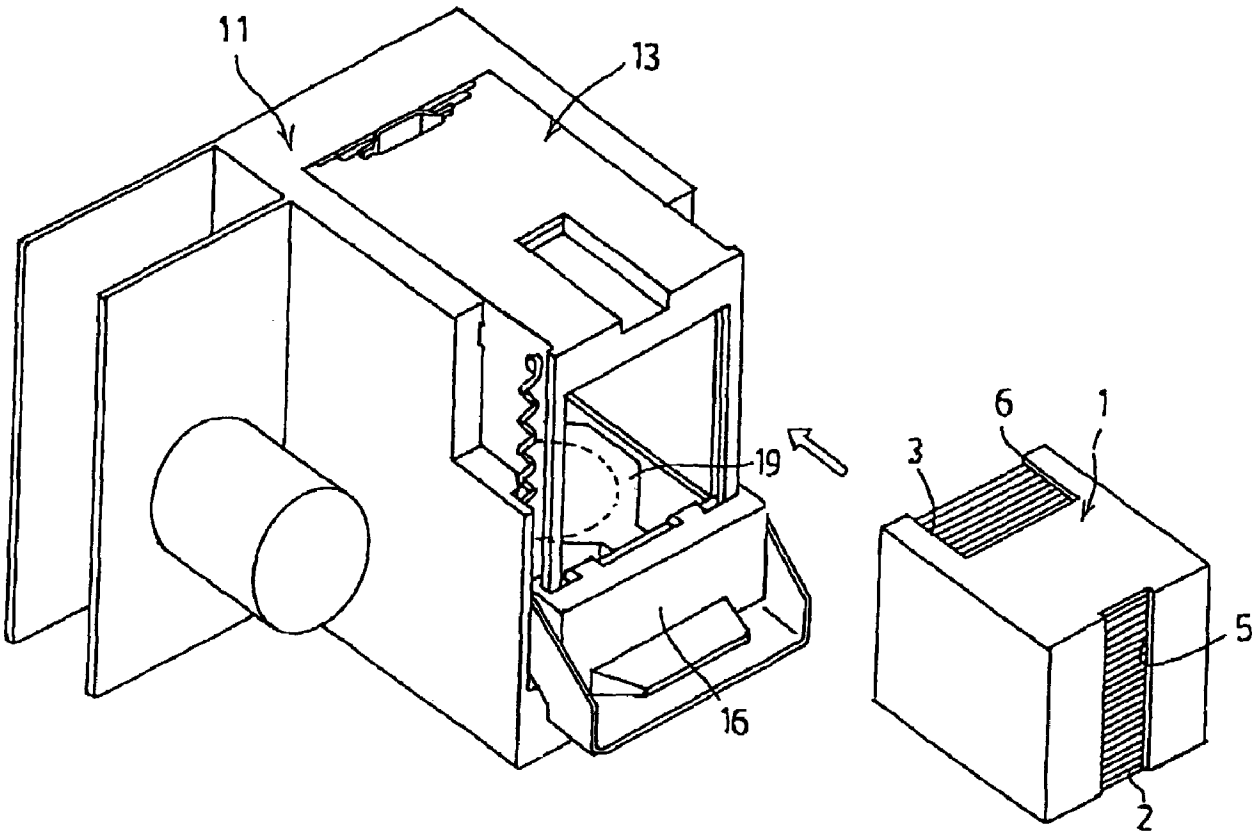
FIG. 4 is a perspective view of a state of mounting the staple cartridge to an electric stapler.
Figure 5:
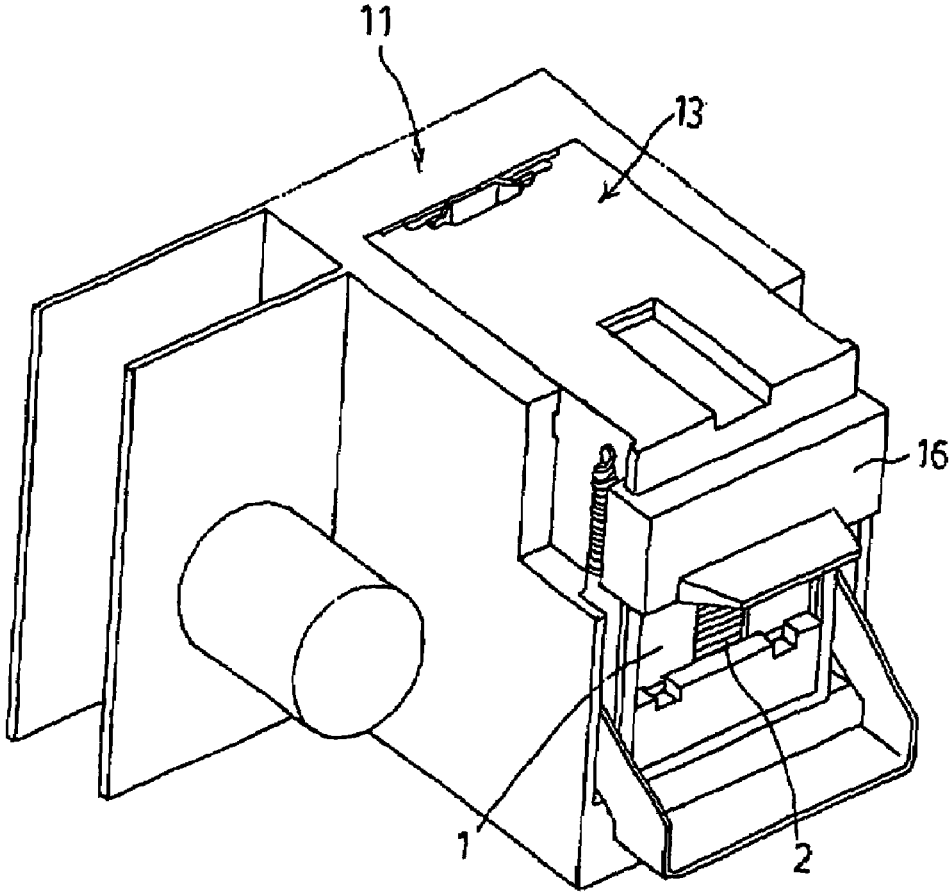
FIG. 5 is a perspective view of a state of charging the staple pack to the staple cartridge.

FIG. 4 shows a state of mounting the staple cartridge 13 to the driver unit 11 of the electric stapler and in charging the staple pack 1 to the staple cartridge 13, the slide door and the pressing plate 19 are pushed down to the lower side as shown by the drawing, and the staple pack 1 is inserted into the staple cartridge 13 when the rear side of the staple cartridge 13 is open. After inserting the staple pack 1, when the slide door 16 is released from being pushed down, as shown by FIG. 5, the slide door 16 is moved up to an initial position by being pulled by the tension coil springs 17 and the rear face of the staple pack 1 is covered. The pressing plate 19 is brought into elastic contact with the lower face of the staple sheet 2 via the bottom face window 4 of the staple pack 1 and a whole staple pack 1 is pressed to a ceiling face at inside of the staple cartridge 13. A feed claw (not illustrated) disposed at an upper portion at inside of the staple cartridge 13 is brought into contact with an upper face of the topmost staple sheet 2 exposed at the upper face window 3 of the staple pack 1 and feeds the topmost staple sheet to the front side by being driven to reciprocate in the front and the rear direction by a staple feeding mechanism of the electric stapler. The rear face window 5 is provided as an escapement groove when the pressing plate 19 is moved up in accordance with a reduction in a number of sheets of the staple sheets.

In the case of using up the staples, when the slide door 16 and the pressing plate 19 are pushed down and the empty staple pack 1 is drawn out and the new staple pack is charged thereto, the new staple pack can immediately be used.

Further, the invention is not limited to the above-described embodiment but can variously be modified within the technical range of the invention and the invention naturally covers the modifications.

The application is based on Japanese Patent Application (Japanese Patent Application No. 2001-350670) filed on Nov. 15, 2001 and a content thereof is incorporated here by reference.

INDUSTRIAL APPLICABILITY

As has been explained above, the staple pack of the invention is formed with the windows by which the feed claw and the pressing plate of the staple cartridge can be brought into contact with the staple sheet and the outlet of the staple sheet and can be charged to the staple cartridge as it is and therefore, different from the replenishing staple sheet of the background art, it is not necessary to unpack the package or remove the bundling strap and therefore, charging is simple and handling performance is improved.

The invention claimed is:

1. A staple pack, for being charged to a staple cartridge of a staple refilling type, stacking staple sheets comprising linear staples adhered in parallel with each other, and containing the staple sheets in a box-type pack, comprising:

an upper face window formed on an upper face of the box type pack from a middle portion in a front and rear direction to a front end of the upper face, and continuous to a staple outlet formed at an upper edge portion of a front face of the box type pack;

a rear face window formed on a center of a rear face of the box type pack in a left and right direction, to extend to upper and lower ends of the box type pack, and a bottom face window continuous to a lower end of the rear face window, wherein when the staple pack is charged to the staple cartridge, a staple feed claw is brought into contact with the staple sheet via the upper face window; and wherein a pressing plate at inside of the staple cartridge is brought into contact with the staple sheet via the bottom face window.

2. The staple pack according to claim 1, wherein the staple pack is formed in accordance with planer dimensions of the staple sheet.

3. The staple pack according to claim 1, wherein the staple pack is made of paper.

4. The staple pack according to claim 1, wherein the bottom face window is matched to a shape of the pressing plate of the staple cartridge.

5. The staple pack according to claim 1, wherein the staple outlet comprises a slit extended to a total width of the staple pack.

6. The staple pack according to claim 1, wherein the rear face window is provided as an escapement groove in moving the pressing plate.

7. The staple pack according to claim 1, wherein the staple sheets are held in the staple pack without a bundling strap.

* * * * *